US005263725A

United States Patent [19]

Gesmer et al.

[11] Patent Number: 5,263,725

[45] Date of Patent: Nov. 23, 1993

[54] SKATEBOARD TRUCK ASSEMBLY

[76] Inventors: Daniel Gesmer, 2504 Cerro Vista Dr., Rockford, Ill. 61107-1006; Max Haug, Alte Landstr. 11, 7470 Albstadt 1, Fed. Rep. of Germany

[21] Appl. No.: 840,046

[22] Filed: Feb. 24, 1992

[51] Int. Cl.[5] ..... A63C 17/02

[52] U.S. Cl. ..... 280/11.28; 280/87.042

[58] Field of Search ..... 280/11.28, 87.042, 724, 280/112.1

[56] References Cited

U.S. PATENT DOCUMENTS

| | | | |
|---|---|---|---|
| 2,537,213 | 1/1951 | De Vault | 280/11.28 |
| 3,252,713 | 5/1966 | Heller | 280/87.042 |
| 4,054,297 | 10/1977 | Solimine | 280/11.28 |
| 4,152,001 | 5/1979 | Christianson | 280/11.28 |

*Primary Examiner*—Edwin L. Swinehart
*Attorney, Agent, or Firm*—Lee, Mann, Smith, McWilliams, Sweeney & Ohlson

[57] ABSTRACT

An improved skateboard truck is disclosed which incorporates exceptionally rapid and consistently accurate axle rebound to the straight-ahead position, consistent and predictable steering response, an improved balance between stability and maneuverability, fine steering control, and a wide range of steering radii. A yoke containing the truck's axle includes a central body portion with a central aperture therein for a pivot pin. Sockets for containing the ends of coil springs are formed in the yoke on either side of the yoke's central aperture. A baseplate includes a second aperture for receiving the end of the pivot pin, and the pivot pin itself extends through the yoke into the baseplate. Second sockets for receiving the other ends of the coil springs are also formed in the baseplate on either side of the second aperture, and the coil springs themselves extend from the sockets in the yoke to the sockets in the baseplate. The sockets are conically shaped. As the yoke turns, pivoting the wheels on the outer ends of the yoke in a very fixed arc about the pivot pin, the coil springs remain substantially columnar and unbuckling as they pivot at each of their ends in the sockets' bases.

21 Claims, 3 Drawing Sheets

FIG. 1
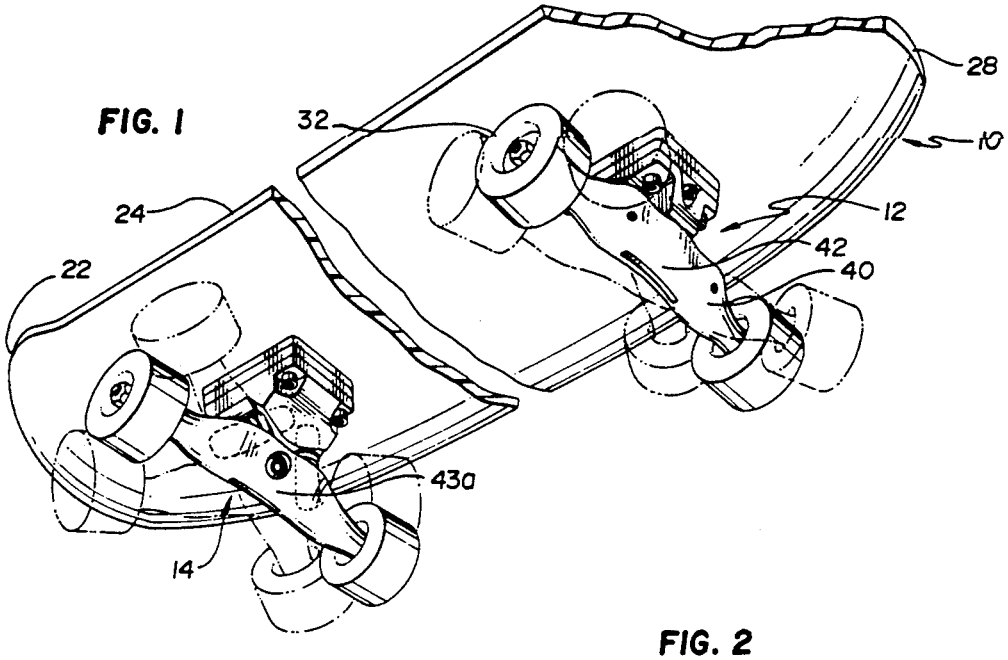
FIG. 2
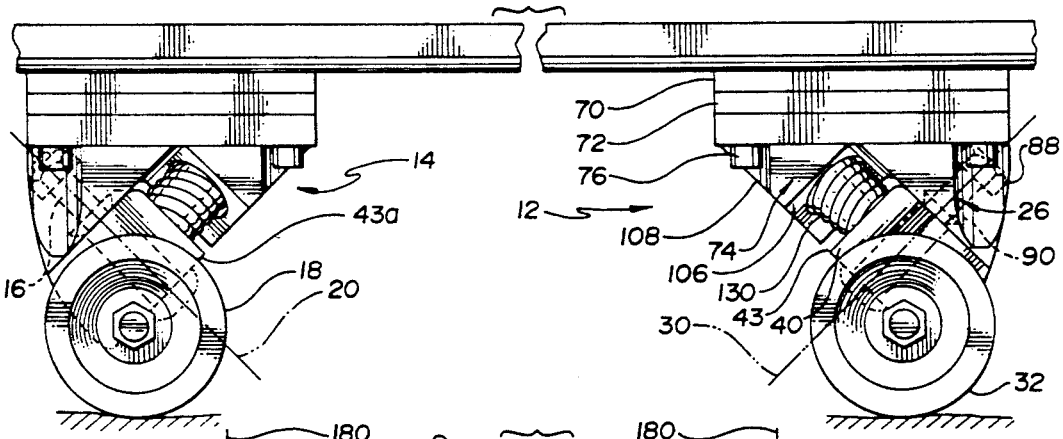
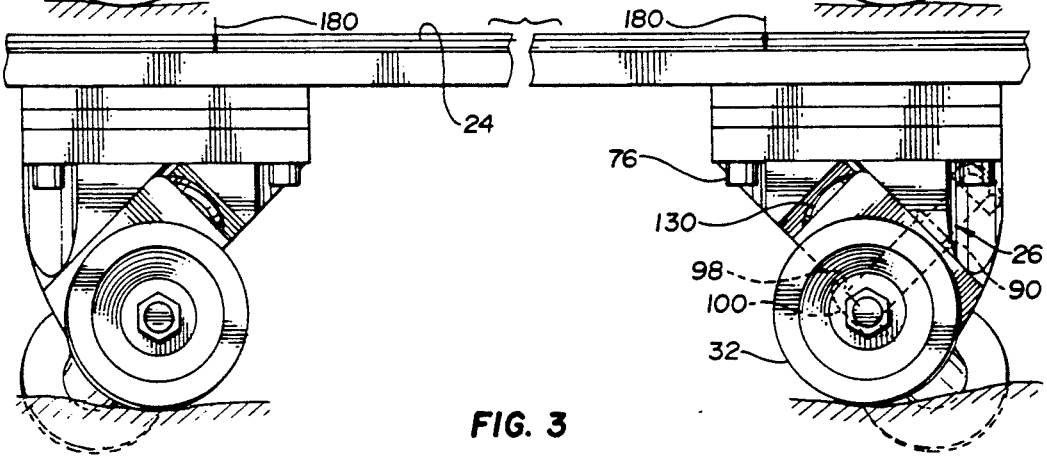
FIG. 3

SKATEBOARD TRUCK ASSEMBLY

This invention pertains to assemblies for mounting pairs of wheels to the underside of a skateboard deck. More specifically, it pertains to a novel skateboard steering mechanism known as a truck.

BACKGROUND OF THE INVENTION

Conventional skateboards are equipped with steering mechanisms known as trucks. The trucks are mounted on the underside of a skateboard opposite to each other, one in the front and one in the rear. Each truck carries two wheels, one at each end of the truck's axle. Most skateboards are sold as separate elements, namely the deck, trucks, and wheels. These elements are assembled, together with a few accessories, by either the buyer or the retail seller.

The sport of skateboarding includes many different styles of competition, such as streetstyle, ramp riding, bowl riding, freestyle, slalom racing, and downhill racing. The equipment used in serious skateboarding pursuits must meet exacting performance requirements. The truck or chassis of the board determines many of the most crucial performance characteristics.

Skateboard trucks serve four main purposes: 1) to connect the skateboard's wheels to the skateboard deck; 2) to provide a wide-ranging steering response, whereby the wheel axles swivel to create a finite turning radius when, by means of lateral weight shifts, the skateboarder tilts the deck about its longitudinal axis; 3) by means of a suspension system, to smoothly and predictably resist the skateboarder's efforts to tilt the deck, thus stabilizing the vehicle during straight-ahead riding and providing control over the steering response; and 4) by means of the same suspension system, to generate a force which will quickly return the skateboard to the neutral, non-turning position after the skateboarder discontinues a lateral weight shift.

Skateboard dimensions have varied a great deal during the course of the sport's history. They also vary somewhat according to the preferences and habits of the user. At present, however, the decks on which skateboarders stand are usually about 9 to 10 inches wide and 30 to 31 inches long. Decks may be formed of laminated wood or other shaped material which provides a relatively flat center portion, viewing the board from nose to tail, often a slightly and gradually upturned nose, and usually a more sharply upturned tail portion. Throughout most of their length skateboard decks are wide enough to accommodate a skateboarder's foot positions angularly across the longitudinal axis of the board. Across their width skateboard decks usually have a concave profile to give the rider better feel for the edges of the skateboard.

Presently, skateboard wheelbases, that is, the distance from the front axle to the rear axle, average approximately 17 inches to 19 inches. The axles are usually about 9 inches long, and they carry wheels which are normally about 1.6 inches to 2.75 inches in diameter and 1 to 1.50 inches wide. The wheels are typically radiused on both the inside and outside edges, and they are usually made of urethane compositions.

Generally, a skateboarder stands on a skateboard deck with his feet approximately shoulder-width apart, the rear foot being placed on or near the upturned tail of the board and the forward foot being placed slightly behind the board's nose. For simple maneuvers, a skateboarder stands on the skateboard deck in a generally upright position. However, from instant to instant he may shift his weight from one side of the board to the other or toward the nose or the tail. For more intricate maneuvers, the skateboarder may shift his feet further apart, bracing them against the nose and tail curvatures of the deck, or closer together. He may crouch over the board, balancing himself with outstretched arms, forwardly-leaning shoulders and rearwardly-positioned buttocks. The wheels beneath the skateboard deck are located to accommodate both simple and intricate maneuvers, taking into account how far apart a skateboarder may position his feet and shift his weight for both types of maneuvers.

Ideally, a skateboarder should steer the skateboard in such a way that his body is leaning at the same angle as the skateboard deck is tilted. In other words, the skateboarder's body should remain perpendicular to the skateboard deck at all times. This allows the skater to center his movements in the pelvis, which in turn produces an optimal accord amongst muscular efficiency, balance, control, power, quickness, and traction. Yet, if the skateboarder is using ideal turning technique, the modern skateboard will turn stably at only one velocity. Depending on the brand of truck and the length of the wheelbase, this velocity will usually be between 3 and 6 miles per hour. Even at that speed, however, the steering response of the conventional truck is only roughly stable. At all other speeds, skateboarders are presently forced to compromise their skating form to compensate for the insensitivity of their trucks. It has, therefore, been extremely difficult for skateboarders to take full advantage of the turning action of their skateboards.

By altering the angle of the arm on which the wheel axles pivot, i.e., the angle between that arm and the longitudinal axis of the deck, or by varying the length of the skateboard's wheel base, it is possible to slightly increase or decrease the forward velocity at which the skateboard steers well. However, skateboards need to turn stably through a wide range of speeds.

Conventional skateboard trucks follow a basic design in which an axle pivots about an arm attached at one end to the center portion of the axle. The other end of this pivot arm is loosely fitted, at an angle of approximately 45°, into a plastic cup mounted in a baseplate, thus forming a ball-like joint. A pair of doughnut-shaped grommets, usually made of rubber or urethane plastic of varying hardnesses, is mounted on a substantially vertical king pin fixed in the baseplate on the side of the axle opposite the plastic cup. These grommets grasp a ring extending from the axle body so that the axle is suspended between the ball joint and the grommets. By adjusting the king pin, the tension on the grommets may be increased or decreased, thereby varying the balance between turning stability and turning ease. One example of this standard design is shown in U.S. Pat. No. 3,862,763, issued Jan. 28, 1975, to Gordon K. Ware.

The king pin employed in conventional skateboard trucks is oriented at a substantially right angle to the tilting movement of the deck, resulting in high stress on the king pin. Because the king pin and the grommets do not adequately stabilize the pivot arm axis, and because of the loose fit between the pivot arm and the plastic cup, the angle of the pivot axis tends to deteriorate as the axle tilts, so that very tight turns may be difficult or impossible to achieve.

A further drawback of this standard design is that the suspension system formed by the plastic grommets fails to provide fine steering control. Skateboarders control the angle of the deck's tilt, and thus the size of the turns they make, by varying the distance by which they shift their weight laterally across the width of the deck. Regardless of their hardness or of how they are adjusted, the standard urethane grommets do not offer a regular, orderly pattern of resistance to such weight shifts. The result is that skateboarders cannot easily predict or measure how far they must shift their weight to achieve steering radii of various sizes.

Also, conventional skateboard trucks generally mandate a severe trade-off between stability and maneuverability, such that skateboarders may achieve turning stability or turning ease, but usually not a combination of or balance between the two. Turning stability is understood to mean a relative insensitivity to sideward weight shifts, such that a skateboarder may fluctuate his body mass across much of the width of the deck without causing the skateboard to tilt or turn very much. Turning ease, or maneuverability, is understood to mean a relatively greater sensitivity to sideward weight shifts, such that a skateboarder may achieve tight turns through relatively smaller lateral displacements of his body mass. When adjusted to be relatively maneuverable, standard trucks tend to respond much too quickly to sideward weight shifts, thereby becoming disproportionately unstable, especially at high speeds. When adjusted to be relatively more stable, conventional trucks tend to respond much too slowly, thus losing most or all of their ability to make tight turns. A middle ground or compromise between turning ease and turning stability is thus difficult to achieve.

Moreover, when a skateboarder removes his weight from the side of the deck at the end of a turn, the plastic grommets used in conventional trucks do not return the skateboard to the neutral, non-turning position quickly enough. Sideward shifts of a skateboarder's body mass create forces which compress the grommets, thus causing the deck to tilt and the skateboard to steer. Conventional trucks behave like dampers in the sense that the energy used to compress the grommets is largely dissipated; the grommets retain very little of this energy for use in quickly rebounding the axles to the straight-ahead position. This is especially noticeable, and troublesome, when the skateboarder attempts to propel and accelerate himself by means of quick alternating turns. High-performance skateboarding depends upon the ability of the trucks to quickly resume straight-forward motion after the skateboarder discontinues a lateral weight shift.

Additionally, conventional skateboard trucks often begin to feel kinked, as if they "want" to steer in one direction more than the other, such as to the left more than to the right. The plastic cup in which the axle pivot arm swivels, and the urethane grommets, tend to permanently deform in an asymmetrical manner in accordance with the skateboarder's steering habits and may oppose his attempts to steer the skateboard either straight ahead or against the memory of the plastic cup and grommets.

Finally, conventional trucks feature irregular shapes on the sides which face the center of the skateboard, so that they may catch or hang up on the edges of objects which skateboarders may jump onto, such as curbs, low walls, or the lips of ramps and bowls. This may put the skateboarder at risk of harmful falls.

Heretofore in the patent art various forms of wheel suspension systems have been utilized in foot-operated rolling equipment such as roller skates. One such system is shown in U.S. Pat. No. 319,839 issued Jun. 9, 1885 to I. P. Nelson. In that patent, the shoe supporting deck portion of a roller skate is mounted on two trucks. Each truck includes a pair of helical springs, each with a lower end disposed against a plate on an axle carrying a set of wheels. The plate contains apertures for the lower ends of a pair of rods to slide through. The rods also extend through the centers of the springs and an adjusting nut on each rod is tightened down against the upper end of the spring to give it tension. Each rod hangs from a pair of lugs fastened to the underside of the shoe supporting deck. The springs and rods have their longitudinal axes in parallel planes which are normal to the shoe supporting deck. A rocker pin rotatably attaches the plate and axle to a hanging member depending from the underside of the deck between the springs so that the plate and wheel axle of each truck can move in a curved path beneath the shoe supporting deck. The office of the springs is to normally hold the skate deck parallel to the horizontal plane of the wheel-axles, under which conditions the two axles of the skate should be in parallel vertical planes. The lower ends of the rods slide up or down through the plate on the axle as one wheel or the other rises and returns to normal.

Another form of mechanism for permitting the wheels of a roller skate to move through an arcuate path against the tension of helical springs is shown in U.S. Pat. No. 321,434 issued Jul. 7, 1985 to O. Harrison. In that patent, a finger member called a T-piece is affixed to an axle housing, and the central leg of the T is disposed between the ends of two springs mounted opposite to each other on a common horizontal axis. As the axle in the had of the T moves through an arcuate path, the central leg of the T is resisted by one spring or the other.

Still another form of mechanism for controlling the arcuate movement of wheel axles beneath the deck of a roller skate is shown in U.S. Pat. No. 865,441 issued Sep. 10, 1907 to G. S. Slorum. The forward and rear trucks are fastened to the roller skate deck entirely with springs. In this assembly coil springs between the trucks are positioned with their longitudinal axes normal to the skate deck in all vertical planes. The springs will accommodate slight movements of the trucks in any direction and will act to cushion and take up any shocks or vibrations produced by running over uneven surfaces or by encountering slight obstacles.

Yet another form of spring suspension in the front truck of a roller skate is shown in U.S. Pat. No. 2,128,865 issued Aug. 30, 1938 to C. Vogt. Coil springs are disposed upon upright pins from a wheel truck. The pins extend partway up into the centers of the spring coils. The assembly is designed to dissemble slight shocks on the front wheels of the roller skate. The coil springs act between the upper surface of the skate deck and the under surface of the truck. The pivotal suspension permits the wheel truck to pivot slightly relative to the bracket to absorb shocks imparted to the front wheel assembly.

In U.S. Pat. No. 2,424,819, issued Jul. 29, 1947 to S. Guttridge, an axle housing having an axle, with wheels at its distal ends, is suspended well below the deck of a skate. The housing supports a pivot pin which is inclined at an upward angle toward the deck in a vertical plane. A yoke within the axle housing is resiliently clamped upon the pivot pin. Tapped holes in the axle housing communicate with the yoke and contain helically-shaped springs bearing at one end upon the yoke to press it into interlocking engagement with the pivot pin and bearing at the other end back upon screws plugging the springs, exits from their holes. The freedom of the pivot pin to turn against the yoke is thus regulated by the pressure bearing upon the pivot pin brought about by advancing and tightening the screws on the springs to force the yoke into contact with the pivot pin.

U.S. Pat. No. 2,537,213 shows a truck mounted on the underside of a skate deck. An arm with a ball at its upper end depends from a ball socket affixed immediately below the deck. The arm is arranged to twist in the socket and also to allow its lower end to move vertically against a pair of coil springs. An axle extends horizontally through a housing which is also attached at one end to the arm. The other end of the housing is engaged upon a floating pivot pin. Thus, the wheels on the axle can move vertically in concert or independently against the pair of coil springs biased against the arm, as well as pivoting from the ball and socket joint, and they may also pivot about the pivot pin which, in turn, floats against a third spring.

The skateboard truck shown in U.S. Pat. No. 4,054,297 provides a horizontal spindle parallel to the longitudinal axis of the skateboard for the axle of the truck to rock upon. A pair of plates affixed to the underside of the skateboard crosswise of the longitudinal axis hang the horizontal spindle between them beneath the skateboard. Above the horizontal spindle a plate is suspended beneath the longitudinal axis of the skateboard, and a pair of coil springs, each with an end pressing upon the plate, extend to the wheel axle carriage pivotally mounted upon the horizontal spindle. The springs are intended to keep the axle horizontally level beneath the board.

SUMMARY OF THE INVENTION

In the present invention a pair of novel skateboard trucks are fastened to the underside of a skateboard deck. In each truck there is a yoke which includes a central body portion with end portions extending outwardly. At the distal ends of the end portions there are means for engaging skateboard wheels. A first aperture is formed in and extends through the center of the body portion. First sockets formed in generally frustoconical shape are disposed in the body portion on opposite sides of the first aperture. These sockets have longitudinal axes directed away from the body portion, and they converge toward each other. The truck also includes a baseplate in which a second aperture is formed for receiving a pivot pin, and there are second sockets, also of generally frustoconical shape, on opposite sides of the second aperture which have longitudinal axes directed away from the baseplate. The longitudinal axes of the second sockets diverge away from each other. A truck pivot pin extends through the first aperture in the yoke and into the second aperture. Means are provided for engaging the pivot pin onto the baseplate so that the yoke is joined to the baseplate in a pivotal connection. The body portion of the yoke is disposed upon the baseplate and is rotatable thereon about the pivot pin to dispose the end portions of the yoke in an arcuate path. Coil springs are provided having first end portions disposed in the first sockets in the yoke and having second end portions disposed in the second sockets in the baseplate.

It is one object of this invention to provide a new and improved steering mechanism for skateboards, roller skates, roller skis and similar land vehicles in which a platform or deck is mounted on at least one wheeled truck.

It is another object of this invention to provide a new and improved steering mechanism for a skateboard or similar vehicle for achieving sharp turns, consistent and predictable steering response, fine steering control, and a wide range of steering radii.

It is another object of this invention to provide a new and improved truck utilizing coil springs disposed intermediate a baseplate and an axle holder which in combination afford to a skateboard or similar vehicle an improved balance between turning stability and turning ease.

It is still another object of this invention to provide a new and improved truck for a skateboard or similar vehicle in which resilient coil springs are disposed in downwardly diverging directions from a baseplate on the underside of a deck to an axle holder, thereby achieving exceptionally rapid and consistently accurate axle rebound to the straight-ahead position and tending to propel the skateboarder out of the skateboard's turns with great power.

Other objects and advantages of this invention will become apparent from a consideration of the following drawings and detailed description of one embodiment of the invention.

BRIEF DESCRIPTION OF THE DRAWINGS

For a more complete understanding of this invention, reference should be made to the accompanying drawings in which:

FIG. 1 is a perspective view of the underside of a skateboard, partially broken away, including a depiction of the skateboard trucks of the present invention variously moved to the positions shown in phantom;

FIG. 2 is an elevational view of the skateboard shown in FIG. 1 showing the trucks with the wheels in their normal position for moving the skateboard straight ahead as shown in solid lines in FIG. 1;

FIG. 3 is an elevational view of the skateboard shown in FIGS. 1 and 2 when a skateboarder's weight is moved toward the viewer of FIG. 3 and showing the trucks with the foreground wheels moved closer to the deck of the skateboard to accomplish a right turn of the skateboard;

DETAILED DESCRIPTION OF THE PREFERRED EMBODIMENT

Figure 4:
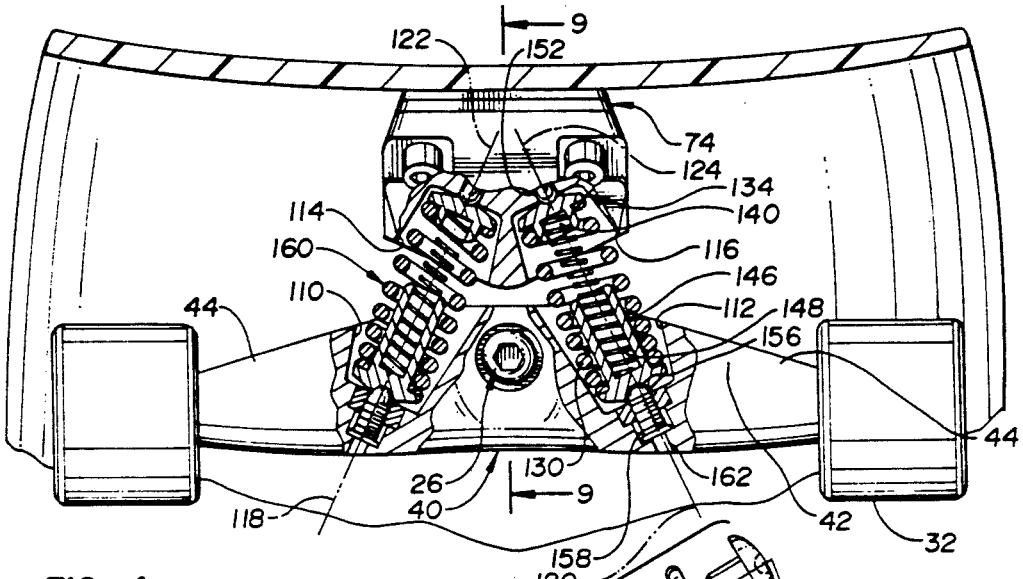
FIG. 4 is an enlarged view in elevation and partly broken away of the truck in FIG. 1 at the front end of the skateboard, when a skateboarder's weight is equally balanced between the left and right sides of the board as viewed in FIG. 4.

In the drawings, one preferred embodiment of the invention is shown which is a skateboard 10 supported upon a pair of the novel trucks 12 and 14. While the preferred embodiment described is a skateboard, it should be understood that the invention, including its various elements, will also be applicable to other rolling platform vehicles which are powered by the rider, or by gravity, or by some combination thereof.

In the following paragraphs the truck 12 which is mounted toward the front of the skateboard will be the truck principally described, but it will also be understood that the truck 14 which is mounted toward the rear of the skateboard has an identical construction. However, as shown particularly in FIG. 2, the pivot pin 16 about which the rear truck wheels 18 rotate has a longitudinal axis 20 extending upwardly in a vertical plane toward the rear end, or tail, 22 of the skateboard deck 24. The pivot pin 26 in truck 12 mounted toward the front, or nose, 28 of the skateboard has a longitudinal axis 30 which extends upwardly in a vertical plane toward the nose of the skateboard, and the front truck wheels 32 rotate about this pivot pin. The front and rear trucks 12 and 14 are thus oppositely disposed to each other.

Figure 7:
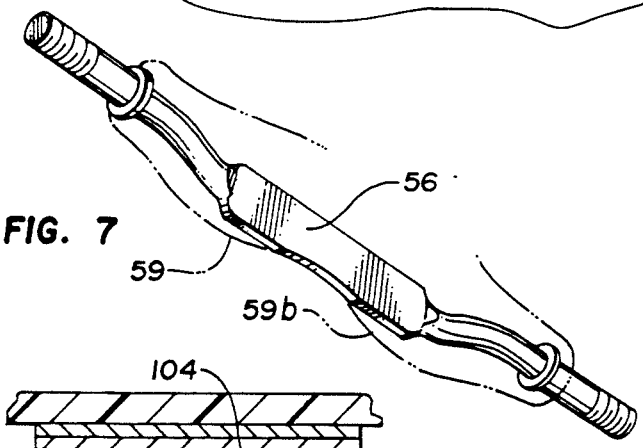
FIG. 7 is a perspective view of internal members in a portion of the yoke member in the truck shown in FIG. 5.
Figure 8:
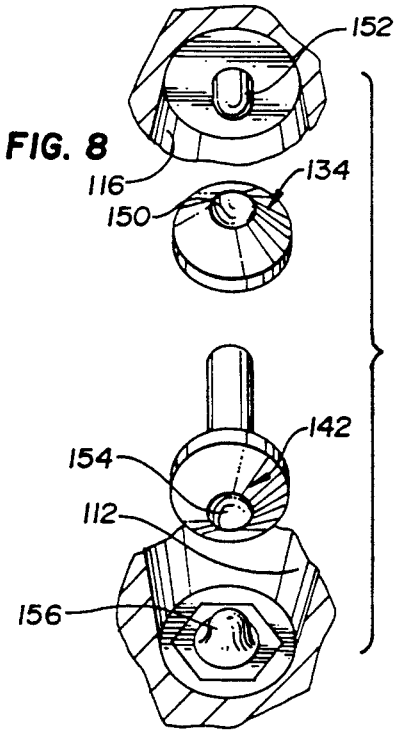
FIG. 8 is an enlarged perspective view partly broken away of certain of the members of the coil spring assembly of the truck shown in FIGS. 4, 5 and 6.

The front truck 12 includes a yoke 40 having a body portion 42 and end portions 44 extending outwardly from the body portion in opposite directions. Means such as threaded ends 46 of axle rods 48 are disposed on the end portions 44 for engaging the skateboard wheels 32. It may also be desirable to join the axle rods 48 in the manner shown in FIG. 7 by providing a metal bight plate 50 which engages the axle rods 48 at both of its ends. The manner of such engagement may be accomplished by forming the axle rods and the bight plate from a single piece of material, as shown in FIG. 7. The bight plate not only forms a unifying link between the axle rods 48, but also strengthens the yoke 40 against vertical stresses and prevents the axle rods 48 from stripping and spinning within the yoke. Such a reinforcement is desirable when the yoke 40 is largely formed from a plastic compound.

Figure 5:
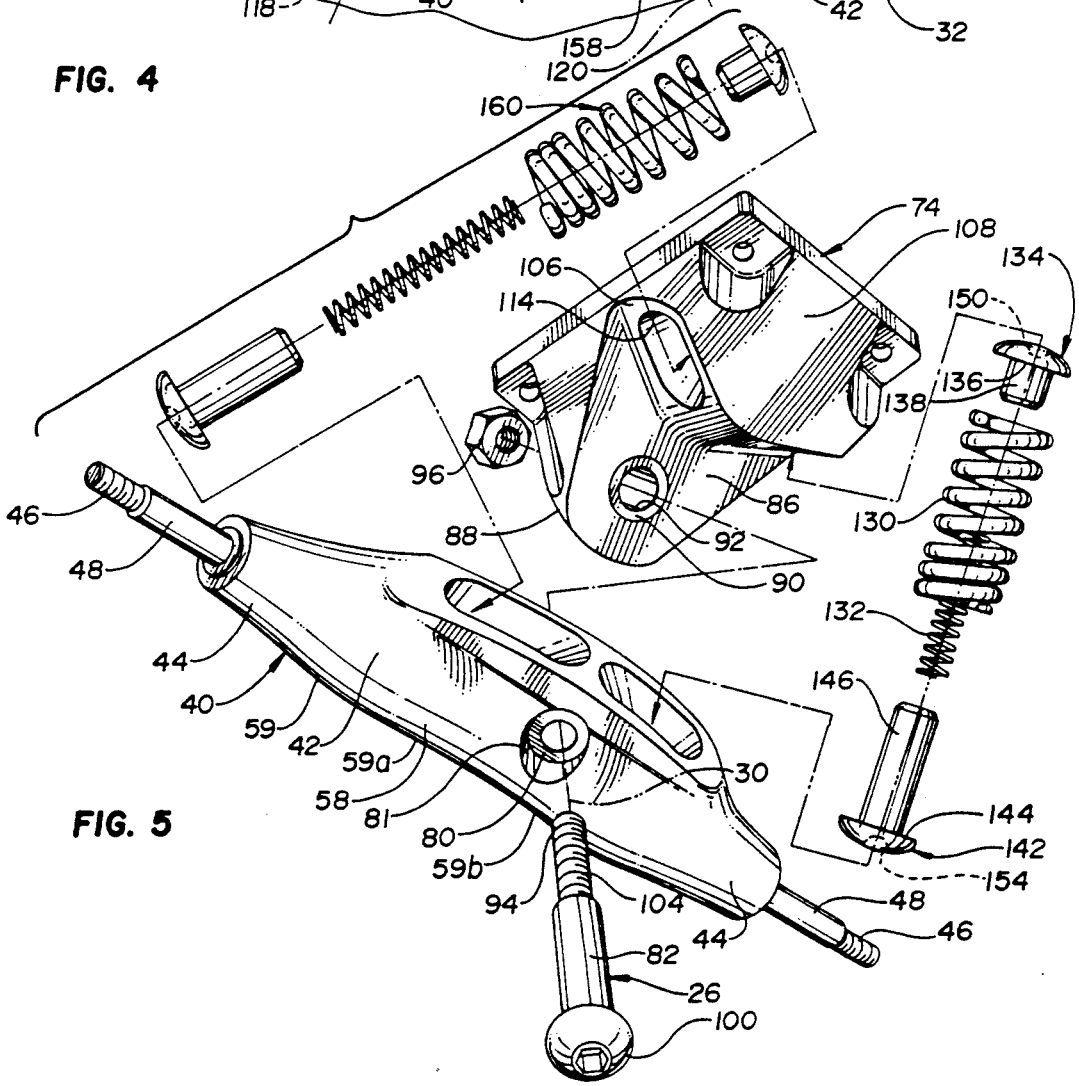
FIG. 5 is an exploded view, with some of the parts partially broken away, of the truck shown in FIG. 4.
Figure 6:
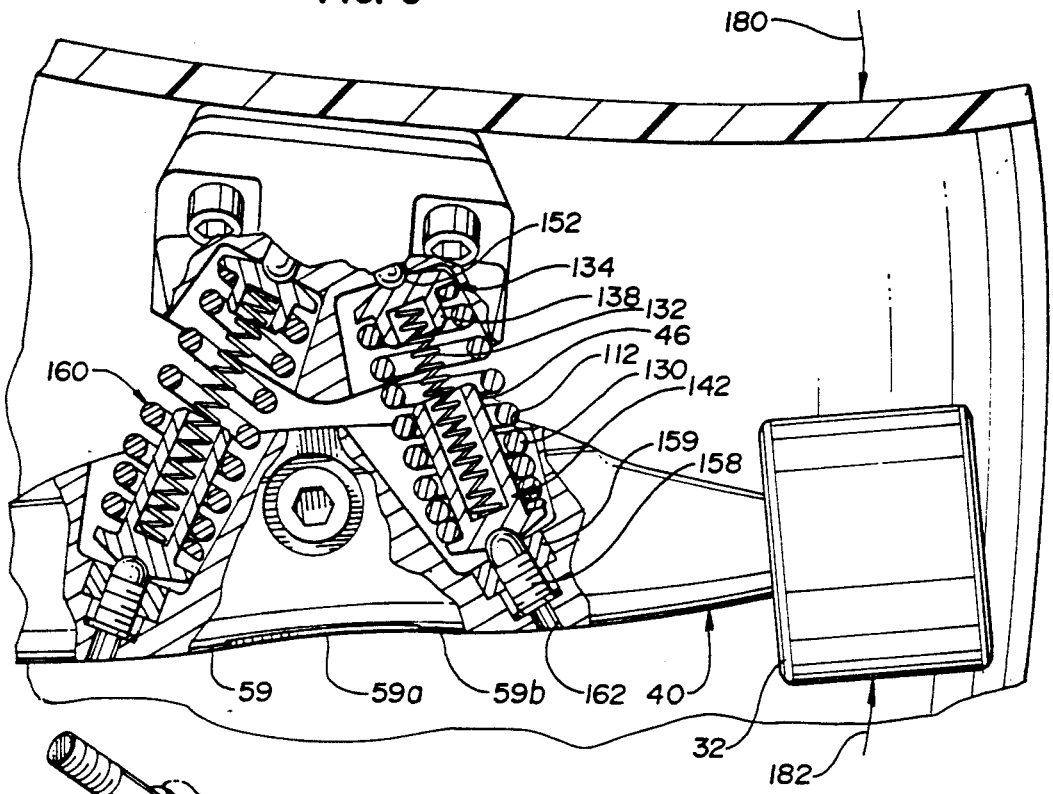
FIG. 6 is an enlarged view of the truck shown in FIG. 4 showing the changed positions of the parts when a skateboarder's weight is disposed more on the right side of the board as viewed in the drawings of FIGS. 4 and 6.

The lower edge 56 of bight plate 50 particularly reinforces the lower depending bottom ridge 58 along the bottom of the yoke. It is well-known to skateboarders that the bottom surface of a truck axle, or any material encasing that axle, is often forcibly impacted by and scraped against hard obstructions such as the edges of curbs, the lips of ramps, or the edges of other raised surfaces which a skateboarder jumps upon. By forming the yoke of the present invention with a reinforcing bight portion between the wheels with its lower edge 56 facing a high-wear area on the bottom of the yoke, substantial durability of the truck is achieved. In addition, the groove or concave channel 59, 59*a*, 59*b* along the bottom of the yoke as one views the yoke from left to right as seen in FIGS. 5, 6 and 7, having its zenith substantially equidistant between the outer extremities of the end portions of the yoke, will tend to keep the skateboarder centered and balanced in the long-wearing middle of the yoke during forcible scrapes, or "grinds", and in so doing will give the skateboarder a better sense of where his skateboard is relative to the scraped surface projection.

It should also be noted that the body portion 42 has a vertically sloped outer face 43 disposed toward the rear truck 14 to permit the skateboarder to jump on curbs, the corners of low walls, or the lips of ramps and bowls, and to disengage freely without any hang-up. The yoke in the rear truck 14 similarly has a sloped outer face 43*a* disposed toward the truck 12 for the same purpose.

As shown in FIGS. 1–4 and 6 the truck 12 is joined to the skateboard deck 24 by interposing one or more pads 70, 72 between the underside of the deck and the baseplate 74 of the truck. The main purpose of the pads is to provide for wheel clearance between the axle and the undersurface of the skateboard. Pads are usually used, but may be omitted if the wheels are especially small or if the trucks are adjusted to be exceptionally stable. Each pad is made of a plastic material which is not readily crushable but is conformable to the underside of the deck and the upwardly disposed face of the baseplate. A series of bolts 76 is arranged to extend through the deck, pads and truck baseplate to secure the truck to the skateboard.

Yoke 40 is mounted on the baseplate 74 by inserting the pivot pin 26 through a tubular grommet 80 which is located in a first aperture 81 centrally disposed in the body of the yoke. The shank portion 82 of the pivot pin fits smoothly but not loosely inside the grommet 80 so that yoke 40 pivots without any trace of wobbling around shank portion 82. Preferably, the shank portion 82 of the pivot pin 26 is self-lubricating with the inner surface of the tubular grommet 80 so that a smooth, low-friction pivotal action is achieved as the yoke 40 pivots around pivot pin 26.

The end of grommet 80 on the side of the yoke facing the baseplate 74 may be formed as a first collar 84. The downward side of the baseplate includes a downwardly facing flat portion 86 located toward the front end 88 of the baseplate, and a flat washer or similar planar member 90 is disposed around a second aperture 92 opening at one end onto the flat portion 86. The opposite end of the second aperture 92 faces onto the front end 88 of the baseplate.

The planar member 90 around the second aperture 92 in the flat portion 86 of the baseplate meets first collar 84 when the yoke 40 is placed against the flat portion 86. Preferably, the first collar 84 and planar member 90 are of self-lubricating materials so that a smooth low-friction pivotal action is achieved as the yoke 40 moves over flat face 86 while pivoting around pivot pin 26. Alternatively, the end of grommet 80 carrying the first collar 84 may simply be formed with an engagement surface 84*a* for meeting and siding upon planar member 90.

Figure 9:
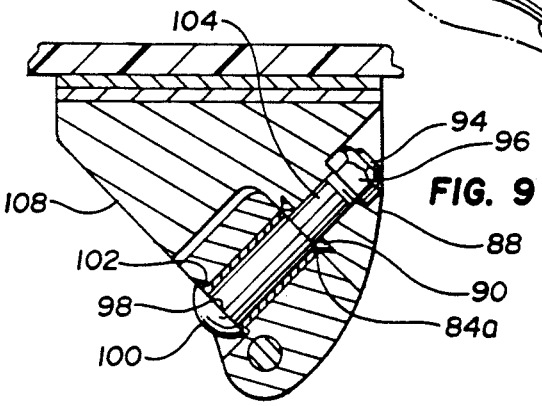
FIG. 9 is a sectional view of the truck shown in FIG. 4 taken in the direction of arrows 9—9 in FIG. 4.

The end of grommet 80 which meets the underside 98 of the head 100 of pivot pin 26 may be formed as a second collar 102 (See FIG. 9). Preferably, the underside 98 of the cap 100 of pivot pin 26 rides smoothly against, and is self-lubricating with, second collar 102.

A threaded portion 94 at the end of pivot pin 26 is engaged by nut 96 at the front end 88 of the baseplate. A second shank portion 104 of pivot pin 26 fits smoothly but not loosely inside of planar member 90 to further secure the pivot pin in the baseplate at a rigid, unwavering angle.

The downwardly facing flat portion 86, and the planar member 90, are arranged to be normal to the longitudinal axis 30 of pivot pin 26. The longitudinal axis 30 forms an angle of about 45 degrees to the longitudinal axis of the skateboard deck 24. Preferably, the first collar 84 and planar member 90 have flat bearing faces which meet and slide against each other throughout the pivoting of the yoke 40, so that the wheels 32 at the outer ends of the yoke are maintained in a very defined, regular arc.

Also, the downwardly-facing flat portion 86 of the baseplate is substantially flush with the first collar 84, and extends outwardly from it in all directions, so that the surface of the yoke 40 adjacent flat portion 86 is provided with an additional support against yoke wobbling as the yoke pivots about the pivot pin 26. Further definition of the pivoting path of the yoke is provided by an arcuate second surface forming a wall 106 which is substantially normal to the flat portion 86 of the baseplate (see FIG. 5). However, as shown in FIG. 4, the wall 106 usually is not contacted by the yoke as the yoke pivots and only provides a limit to the potential movement of the yoke.

The rear end 108 of the baseplate 74 is preferably sloped in the same plane as the outer face 43 of the yoke so that both the outer face of the yoke and the rear end of the baseplate extend downwardly from the skateboard deck in a forward direction toward the nose of the skateboard, thus providing a substantially flat surface which can readily slide off curbs, the corners of low walls, or the lips of ramps and bowls without any hang-up.

The yoke 40 includes a pair of first sockets 110 and 112 on opposite sides of the first aperture 81 containing tubular grommet 80. Similarly, a pair of second sockets 114 and 116 are located in the baseplate on opposite sides of the second aperture 92. Longitudinal axis 118 in socket 110 and longitudinal axis 120 in socket 112 are directed away from the body portion 42 of yoke 40 and converge toward each other. Longitudinal axis 122 in socket 114 and longitudinal axis 124 in socket 116 are directed away from the baseplate and diverge away from each other. As shown in FIG. 4, the axis 118 when it is extended precisely coincides with axis 122, and the axis 120 when it is extended precisely coincides with axis 124, when the yoke 40 is normal to the path of the skateboard as it travels forward in a straight line. The two pairs of axes, 118 and 122, and 120 and 124 will diverge slightly, when the yoke 40 pivots around pivot pin 26. However, as shown in FIG. 6 and as will be described hereafter, the present invention provides for each of the spring assemblies in the first and second sockets to maintain substantially non-buckling straight-line connections between the first and second sockets.

Each pair of first and second sockets, 110 and 114, and 112 and 116, contains a spring assembly for achieving fine steering control, a balance between stability and maneuverability, and a strong, non-kinking, consistently accurate return-to-center force. The assembly in sockets 112 and 116 contains a larger, progressive-rate outer coil spring 130 disposed about a smaller, longer constant rate inner coil spring 132. In socket 116 a pivot button cap 134 is positioned in the end of the larger coil spring 130. The outer edges 136 of the cap overhang the end of the coil spring 130 to keep the cap from being pushed into the center core space of that spring. The shank portion 138 of the cap 134, however, extends into the end coils of spring 130 and is centrally apertured to form a socket 140 to receive one end of the smaller coil spring 132. In a similar manner, a second pivot button cap 142 in socket 112 utilizes outer edge portions 144 around the head of the cap to engage the end coil of spring 130 and keep the cap 142 from being pushed into the cylindrical core space inside the coils of that larger coil spring. The shank portion 14 extends into the other end of spring 130 loosely enough to readily slide in and out, and it is centrally apertured to form a socket 148 to receive the other end of the smaller, longer coil spring 132.

Pivot button cap 134, on the outside of the head of the cap, includes a hemispherically shaped pocket 150 which is dimensioned to engage and rotate upon nib 152 located in the base of socket 116 in a ball and socket connection. Likewise, pivot button cap 142, on the outside of the head of the cap, includes a hemispherically shaped pocket 154 which is dimensioned to engage and rotate upon nib 156 located in the base of socket 112. The nib 156, however, is located upon one end of a set screw 158 which enters the base of socket 112 and can be turned in nut 159 as a spring adjustment screw, such as by an Allen wrench inserted through aperture 162, to vary the compression of the coil springs 130 and 132. It will be noted, also, that the spring 132 particularly serves to keep the pivot button caps 134 and 142 securely positioned on the nibs 152 and 156 when the yoke is turned about the pivot pin 26 to relax the compression on the spring assembly beyond the normal extension range of the larger, outer coil spring 130. At such times spring 132 will push on shank portion 146, causing it to slide outwardly relative to spring 130 so that pivot button cap 142 moves away from the end of spring 130 and maintains contact with nib 156.

The spring assembly utilizing coil spring 160 disposed in sockets 110 and 114 is identical to the spring assembly in sockets 112 and 116 which has just been described in detail.

Comparing FIG. 2 with FIG. 3, the former illustrates the trucks in a straight-forward attitude when the axles are normal to a straight-line path incorporating the longitudinal axis of the skateboard 10. The skateboarder's weight, if one were present on top of the skateboard, would be equally distributed toward both outer edges of the skateboard. In FIG. 3, the trucks are turned to execute a right turn, with a skateboarder's weight predominantly on the side of the skateboard closest to the viewer of this drawing figure. With the skateboarder's weight thus distributed, the weight on the right side of the skateboard pressing downwardly in the direction of arrows 180 causes the spring assemblies in the trucks on the right side of the pivot pin to be compressed and the wheels on the right side of the skateboard to move closer together. The nose of the board swings in an arc toward the right and the tail of the skateboard swings in an arc out to the left to orient the longitudinal axis of the skateboard deck in a right turn.

FIG. 6 is a more detailed, enlarged view of the front truck 12 in the attitude of making a right turn. The view is looking forward toward the nose of the skateboard from underneath the board. As in FIG. 3, the skateboarder's weight is predominantly on the right side of the board's deck according to the arrow 180. The larger, progressive-rate coil spring 130 is somewhat compressed, and the right wheel 32 moves rearwardly and away from the nose of the skateboard in the direction of arrow 182. Cap 142 rolls on the nib 156 in socket 112, as does cap 134 on nib 152. The smaller, inner spring 132 compresses somewhat and the shank portions 138 and 146 of caps 134 and 142, respectively, approach each other but do not touch unless the skateboarder attempts a minimum radius right turn. On the left side of the truck, the caps are maintained in contact with their respective nibs at the bases of the sockets as the left coil spring 160 expands toward its maximum extension. It will be noted, too, that both spring assemblies maintain straight-line contact with the nibs in the bases of the sockets so that they can respond accurately and predictably as the yoke 40 rotates about pivot pin 26 and moves the wheels at the outer ends of the yoke in a finely tuned, predictable path.

The following guidelines are preferably followed in the manufacture of the large outer springs 130, 160. It is assumed in these guidelines that the skateboard deck and wheels are of average dimensions (as above described); that the skateboard rider is of average height and weight [5–6 feet (1.5–1.8 meters) tall, 100–175 pounds (45–80 kilograms)]; that the present invention is constructed on the same general scale as other skateboard trucks [with axles resting 2-2-½ inches (51–63 millimeters) below the top surface of the baseplate]; and that the strength of the inner springs 132 is negligible.

Excellent results may be achieved using constant-rate springs with gradients in the range of 85–135 Newtons per millimeter. However, finer steering control, and an improved balance between stability and maneuverability, may be achieved using progressive-rate springs as the outer coil springs 130, 160. These springs should have a starting gradient in the range of 70–100 Newtons per millimeter. The gradient should increase 1–5% with every millimeter of spring deflection. Further, as the spring undergoes small deflections (1–4 millimeters), the gradient should grow by a percentage which increases slightly with each millimeter of deflection. As the spring undergoes larger deflections (5 or more millimeters), the gradient should continue to grow, but by a percentage which decreases slightly with each millimeter of deflection.

Such progressive-rate springs may create a substantially linear relationship between a) the angle to which a skateboarder may tilt the skateboard deck to achieve turns of various radii at various velocities, and b) the distance by which he must shift his weight sideward to effect that degree of tilt. The substantial linearity of this relationship results in fine steering control and an improved balance between stability and maneuverability. In other words, such springs will offer a very regular, orderly pattern of resistance to a skateboarder's attempts to tilt the deck, so that he can easily predict and measure how far he must shift his weight sideward to achieve steering radii of various sizes. Further, when suitably adjusted to the individual skateboarder, such springs will flex neither too slowly nor too quickly in response to lateral weight shifts.

The lengths of the shank portions 138 and 146 of the caps 134 and 142 are carefully calculated to protect the springs without compromising the truck's steering range. Before the spring coils 130 and 160 can completely close and undergo potentially destructive forces, the end of the shank of the cap 134 will run into the end of the shank of the cap 142, regardless of the degree to which the adjustment screws 158 have been turned.

If a skater turns the spring adjustment screws too far, so that the screws lose hold of the nuts, such as nut 159, the spring assemblies could possibly fall out. However, the adjustment screws such as screw 158 may include a special safety feature. The ends may be formed in such a way that they are too wide to enter the threads at the base of the socket and will not pass all the way through. In addition, special threaded nuts, such as nut 159 for the spring screws may be mounted in the socket bases which have a wider inner diameter with no threads on the side of the nuts facing away from the socket. This construction will allow the wide end of the screws 158 to go deeper into the nuts before being stopped, thus creating a larger range through which the screws may be adjusted.

The spring assemblies such as the assembly containing coil spring 130 are very simple to handle. Both ends of the inner springs 132 may be glued to the caps 134, 142, so that the spring assemblies cannot be dismantled and so that the parts cannot be lost. The short caps 134 may be firmly pressed into the main springs 130. Otherwise some skateboarders might be inclined to take the assemblies apart, after which they might lose or forget the caps and/or the inner springs and possibly attempt to skate without them.

The skateboard truck of this invention makes it very easy to exchange spring assemblies. One may exchange springs by removing the pivot bolt and simply lifting the yoke off of the spring assemblies and the baseplate. When the old spring assemblies are lifted out of the sockets and new spring assemblies set in their place, the yoke is put back on top, and the pivot pin such as 26 is then inserted through the yoke and fastened into the baseplate. It does not matter which way the replacement assemblies are oriented in the truck; there is no right-side-up and no upside-down.

The aperture 162 in the yoke 40 through which the tension on the springs is adjusted preferably should only be large enough for the wrench to pass through, thus prohibiting the spring adjustment screws from ever vibrating out of the truck during use. This construction also insures that the spring adjustment screws 158 are always deep enough for the caps 134 and 142 to roll properly on their respective nibs 152 and 156. Such a construction also makes it very easy to adjust the 30, 160 equally by backing the set screws out as far as they will go, and then counting revolutions of the adjustment screws 158. The spring adjustment screws 158 are recessed so far that "grinding," i.e. allowing the bottom of the truck to scrape on a curb or other ledge, should not ever damage them. However, they can be removed from inside the socket and replaced whenever necessary. Those skilled in the art will readily see that while numerous detailed variations of the above-described embodiment of this invention may be made, the true scope of the invention is to be determined by the following claims.

What is claimed is:

1. a skateboard truck comprising a yoke including a body portion end portions extending outwardly from the body portion in opposite directions, means on the end portions for engaging skateboard wheels, a first aperture extending through the center of the body portion, and first sockets formed in the body portion on opposite sides of the first aperture and having longitudinal axes directed away from the body portion and converging toward each other, a baseplate including a second aperture formed in the baseplate for receiving a pivot pin, second sockets on opposite sides of the second aperture in the baseplate having longitudinal axes directed away from the baseplate and diverging away from each other, a pivot pin extending through the first aperture in the yoke and into the second aperture in the baseplate, means for engaging the pivot pin onto the baseplate to join the yoke to the baseplate in a pivotal connection, the body portion of the yoke being disposed upon the baseplate and rotatable thereon about the pivot pin to dispose the end portions of the yoke in an arcuate path, and first coil springs having first end portions disposed in the first sockets in the yoke and having second end portions disposed in the second sockets in the baseplate.

2. The skateboard truck of claim 1 in which the first sockets in the yoke and the second sockets in the baseplate are frustoconically shaped and include base end portions, and each of the coil springs extends in a substantially direct line from the base end portion of one of the first sockets to the base end portion of one of the second sockets throughout the range of rotation of the yoke.

3. The skateboard truck of claim 2 in which end portions of the springs in the socket base end portions are pivotally mounted in the sockets.

4. The skateboard truck of claim 3 in which at least one of the socket base end portions includes a nib and the adjacent end portion of the spring includes a pocket member engaging the nib forming the pivotal mounting for the spring.

5. The skateboard truck of claim 4 in which the pocket member at the end of the spring adjacent the nib is a cap having a dome-shaped head portion and a shank portion, the shank portion extending into the spring and the dome portion disposed against the end of the spring, and the dome portion also including a pocket in the outer face of the dome for accepting the nib.

6. The skateboard truck of claim 5 in which a second coil spring is disposed within the first coil spring, and caps are disposed on each end of the first coil spring, the second coil spring extending between the caps and urging them onto the nibs in the base end portions of a pair of first and second sockets.

7. The skateboard truck of claim 6 in which the shank portions of the caps are hollow and the ends of the second coil spring are telescoped into the shank portions of the caps.

8. The skateboard truck of claim 6 in which the shank portions of the caps are opposite one another inside the first coil spring and the total length of the shank portions together is greater than the maximum compression of the first coil spring, whereby, when the first spring is firmly compressed, the shank portions of the caps abut one another prior to total compression of the first coil spring to limit compression of the first coil spring.

9. The skateboard truck of claim 1 in which the first coil springs are progressive-rate springs.

10. The skateboard truck of claim 1 in which the first coil springs are constant-rate springs.

11. The skateboard truck of claim 1 in which the yoke includes a reinforcing member extending horizontally through the yoke intermediate the end portions, the central portion of the reinforcing member having an arcuate section with its zenith substantially equidistant between the outer extremities of the end portions.

12. The skateboard truck of claim 6 in which the compression of the first coil spring is increased as the axial distance between the nibs in the first and second sockets is shortened.

13. The skateboard truck of claim 12 in which the nibs are threadably mounted within the socket bases.

14. The skateboard truck of claim 1 in which the compression on at least one of the coil springs is increased by means located adjacent the first end portion of the spring engaging the spring and urging the first end portion of the spring closer to the second end portion of the spring.

15. The skateboard truck of claim 1 in which outer surfaces of the yoke and of the baseplate arranged to be faced inwardly toward the center portion of a skateboard are located substantially in a plane which slopes angularly downwardly from the body of the skateboard and toward the nose of the skateboard.

16. The skateboard truck of claim 15 in which the bearing between the yoke and the base plate is self lubricating and smoothly movable.

17. The skateboard truck of claim 1 in which the coil springs in the sockets on each side of the pivot pin incorporate consistently equal spring rates and resiliency.

18. The skateboard truck of claim 1 in which the end portions of the yoke are disposed in arcuate paths in the same plane.

19. The skateboard truck of claim 5 in which the nib in the base end portion of the socket is disposed in an axially directed path having a limited length providing constant contact between the nib and the pocket in the cap.

20. The skateboard truck of claim 1 in which the yoke includes a reinforcing member extending horizontally through the yoke intermediate the end portions.

21. The skateboard truck of claim 1 in which the outer surface contour of the yoke includes an arcuate section with its zenith substantially equidistant between the outer extremities of the end portions of the yoke.

* * * * *